US008650772B2

(12) United States Patent
Son et al.

(10) Patent No.: US 8,650,772 B2
(45) Date of Patent: Feb. 18, 2014

(54) LAUNDRY MACHINE AND CONTROL METHOD THEREOF

(75) Inventors: Chang Woo Son, Changwon-si (KR); Sang Hun Bae, Changwon-si (KR); Chul Jin Choi, Changwon-si (KR); Dong Hyun Kim, Changwon-si (KR); Young Bok Son, Changwon-si (KR); Heung Jae Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1115 days.

(21) Appl. No.: 11/980,779

(22) Filed: Oct. 31, 2007

(65) Prior Publication Data

US 2008/0148494 A1 Jun. 26, 2008

(30) Foreign Application Priority Data

Dec. 26, 2006 (KR) ..... 10-2006-0133847

(51) Int. Cl.
*F26B 21/06* (2006.01)

(52) U.S. Cl.
USPC ..... 34/524; 34/60; 34/90; 34/597

(58) Field of Classification Search
USPC ..... 34/60, 68, 90, 595, 596, 597, 418, 425, 34/427, 524
See application file for complete search history.

(56) References Cited

U.S. PATENT DOCUMENTS

| | | | | |
|---|---|---|---|---|
| 3,712,086 | A * | 1/1973 | Payet et al. | 68/5 C |
| 5,337,703 | A * | 8/1994 | Schlesch et al. | 122/379 |
| 6,743,986 | B2 | 6/2004 | Dirnberger | |
| 7,730,568 | B2 * | 6/2010 | Wong et al. | 8/148 |
| 2004/0168343 | A1 | 9/2004 | Park | |
| 2005/0050758 | A1 * | 3/2005 | Park et al. | 34/425 |
| 2005/0086979 | A1 | 4/2005 | Son et al. | |
| 2005/0115120 | A1 * | 6/2005 | Cevik | 38/14 |
| 2006/0277690 | A1 * | 12/2006 | Pyo et al. | 8/149.2 |

FOREIGN PATENT DOCUMENTS

| | | | |
|---|---|---|---|
| DE | 31 46 527 | A1 | 6/1983 |
| EP | 6 233898 | A | 8/1994 |
| EP | 0 898 009 | A1 | 2/1999 |
| EP | 1 600 545 | A1 | 11/2005 |
| EP | 1 666 655 | A2 | 6/2006 |
| EP | 1696067 | A | 8/2006 |
| EP | 1734170 | A | 12/2006 |
| EP | 1 852 540 | A1 | 11/2007 |
| EP | 1 852 541 | A1 | 11/2007 |
| EP | 1 852 542 | A1 | 11/2007 |
| EP | 1862581 | A | 12/2007 |

(Continued)

*Primary Examiner* — Jiping Lu
(74) *Attorney, Agent, or Firm* — McKenna Long & Aldridge LLP

(57) ABSTRACT

The present invention relates to a laundry machine that can prevent as well as remove wrinkles of laundry. A laundry machine includes a drum rotatable in a cabinet; a hot air heater to supply hot air to the drum by heating air; a steam generator to supply steam to the drum; a sensor to sense a laundry amount inside the drum; and a controller to control an amount of steam supplied to the drum based on sensing results of the sensor. In another aspect of the present invention, a controlling method of a laundry machine includes sensing a laundry amount inside a drum and drying the laundry by supplying hot air to the drum. In the drying of the laundry by supplying hot air to the drum, an amount of hot air is adjusted based on the laundry amount sensed in the sensing of the laundry amount inside the drum.

11 Claims, 17 Drawing Sheets

(56) References Cited

FOREIGN PATENT DOCUMENTS

| | | | | |
|---|---|---|---|---|
| FR | 2558713 | A | | 8/1985 |
| JP | 2000018782 | A | * | 1/2000 |
| KR | 10-2003-0033895 | A | | 5/2003 |
| KR | 10-2004-0090051 | A | | 10/2004 |
| KR | 10-2005-0102932 | A | | 10/2005 |
| WO | WO 2004-058035 | A | | 7/2004 |

* cited by examiner

LAUNDRY MACHINE AND CONTROL METHOD THEREOF

CROSS REFERENCE TO RELATED APPLICATION

This application claims the benefit of the Patent Korean Application No. 10-2006-0133847, filed on Dec. 26, 2006, which is hereby incorporated in its entirety by reference as if fully set forth herein.

BACKGROUND OF THE DISCLOSURE

1. Field of the Disclosure

The present invention relates to a laundry machine and a controlling method thereof. More particularly, the present invention relates to a laundry machine that can automatically sense an amount of laundry to control an operation thereof, and a controlling method of the laundry machine.

2. Discussion of the Related Art

Laundry machines are typically electric appliances that dry washed laundry, mainly washed clothes, by using high temperature air. In general, a laundry machine is configured of a drum, a driving source, heating means and a blower unit. Laundry is held in the drum and the driving source drives the drum. The heating means heats air drawn in the drum. The blower unit sucks or discharges the air inside the drum.

Laundry machines may be categorized, based on a method of heating air that is heating means, into electric-type laundry machines and gas-type laundry machines. In an electric-type laundry machine, air is heated by using electric resistance heat. While, in a gas-type laundry machine, air is heated by using heat generated from gas combustion. On the other hand, laundry machines may be categorized into condensation-type laundry machines and exhaustion-type laundry machines. In a condensation-type laundry machine, air is heat-exchanged with laundry in the drum and the damp air is circulated, not discharged outside, to be heat-exchanged with external air at an auxiliary condenser. At this time, water is condensed and discharged outside. In an exhaustion-type laundry machine, air is heat-exchanged with laundry in the drum and the damp air is directly discharged outside the laundry machine. Also, laundry machines may be categorized, based on a method of loading laundry, into top loading-type laundry machines and front loading-type laundry machines. In a top loading-type laundry machine, laundry is loaded into the drum through a top of the laundry machine. In a front loading-type laundry machine, laundry is loaded into the drum through a front of the laundry machine.

However, above conventional laundry machines may have following problems.

Commonly, the laundry having performed washing and spinning is loaded and dried in the conventional laundry machines. In a view of a principle of water washing, washed laundry has wrinkles and the wrinkles created during the washing and spinning are not removed during the drying. As a result, auxiliary ironing is necessary in the conventional laundry machine to remove the wrinkles, which causes a problem.

Moreover, in case that clothes rather than the washed laundry are kept and used, the clothes like the washed laundry may have wrinkles, crumples and fold marks (hereinafter, referenced to as 'wrinkles'). Accordingly, there have been demands for development of devices capable of removing wrinkles easily even after common usage and keeping.

SUMMARY OF THE DISCLOSURE

Accordingly, the present invention is directed to a laundry machine.

An object of the present invention is to provide a laundry machine that can prevent as well as remove wrinkles of laundry.

Another object of the present invention is to provide a laundry machine and a controlling method thereof which can automatically sense an amount of laundry which will be dried to control an operation of the dryer.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry machine includes a drum rotatable in a cabinet; a hot air heater to supply hot air to the drum by heating air; a steam generator to supply steam to the drum; a sensor to sense a laundry amount inside the drum; and a controller to control an amount of steam supplied to the drum based on sensing results of the sensor.

In another aspect of the present invention, a controlling method of a laundry machine includes sensing a laundry amount inside a drum and drying the laundry by supplying hot air to the drum. In the drying of the laundry by supplying hot air to the drum, an amount of hot air is adjusted based on the laundry amount sensed in the sensing of the laundry amount inside the drum.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure.

In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

To explain a laundry machine according to the present invention, a top loading-type, electric-type and exhaustion-type laundry machine will be presented as examples on convenience sake. However, the present invention is not limited to the above examples and it can be applicable to a front loading-type, gas-type and condensation-type laundry machine.

Figure 1:
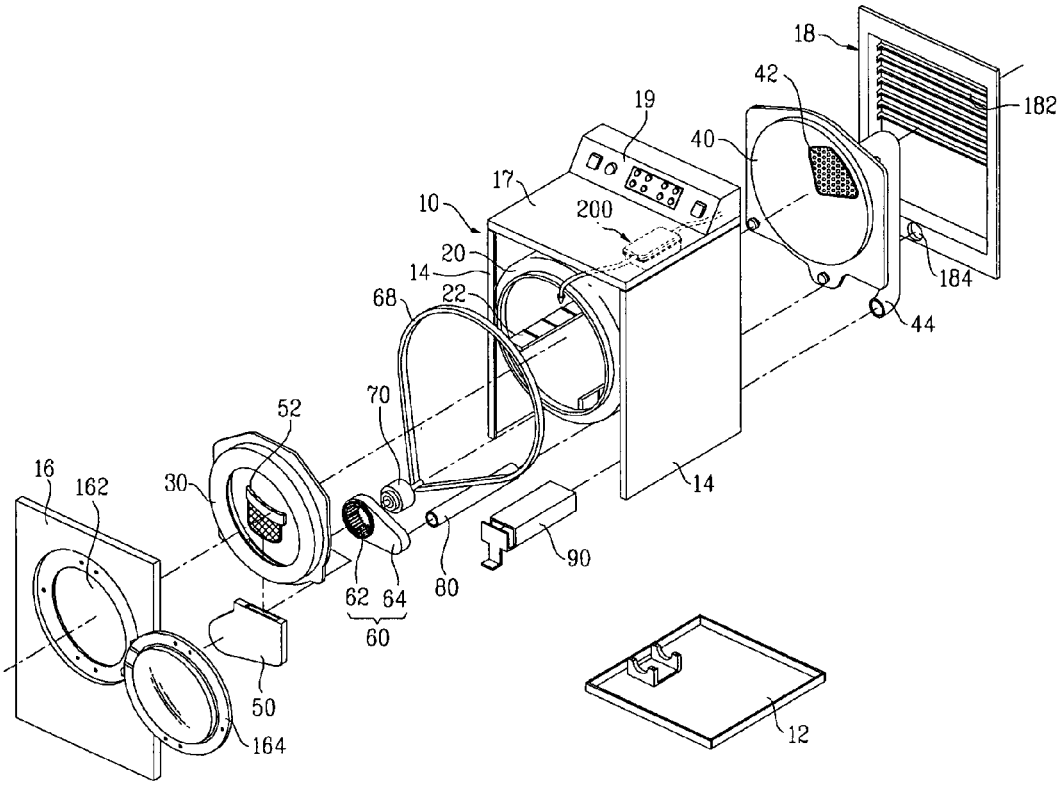
FIG. 1 is a an exploded perspective view illustrating a laundry according an embodiment of the present invention being exploded.
Figure 2:
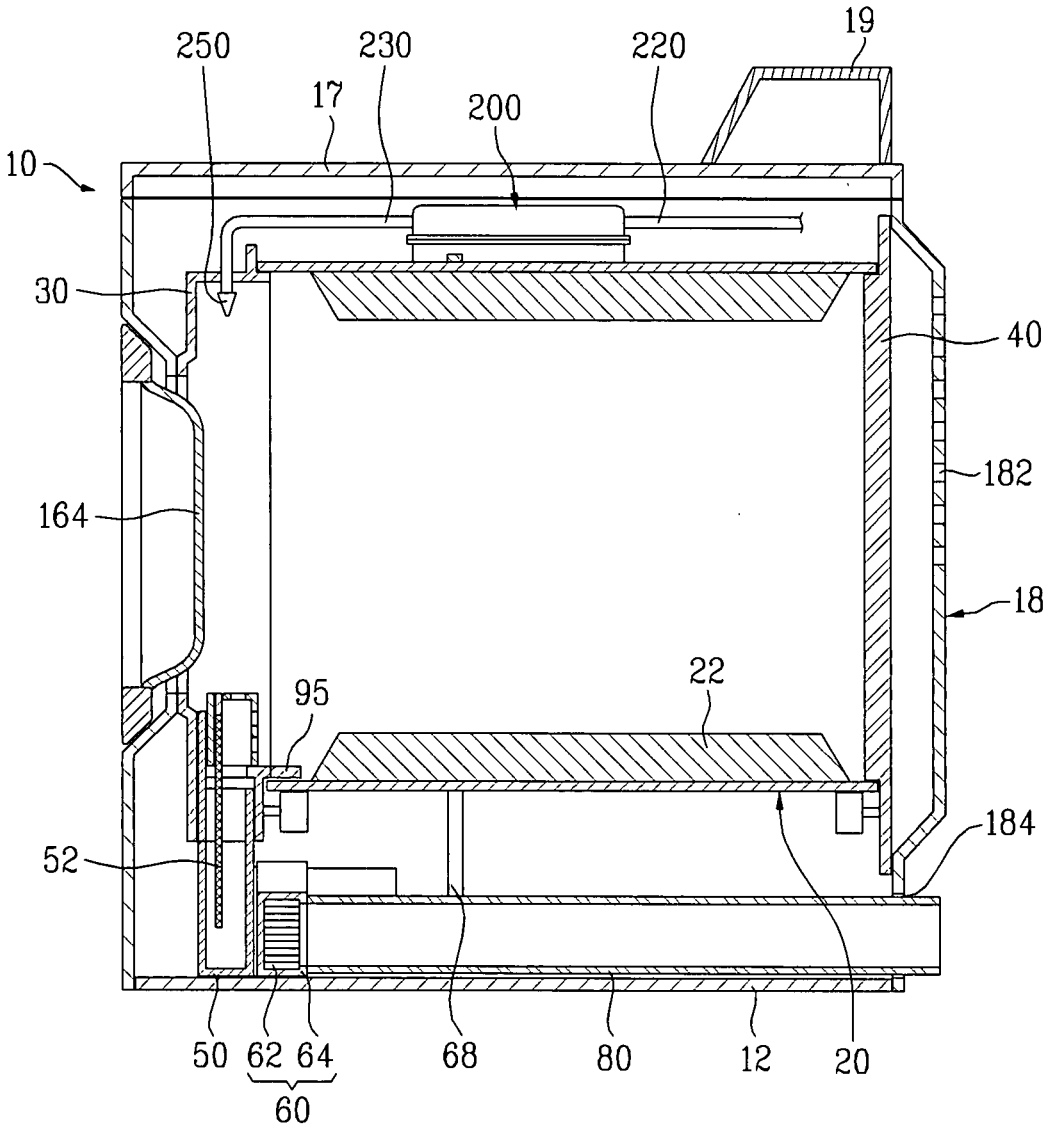
FIG. 2 is a longitudinally sectional view of FIG. 1.

FIG. 1 is an exploded perspective view illustrating a dryer according to an embodiment of the present invention and FIG. 2 is a longitudinally sectional view of FIG. 2.

In reference to FIGS. 1 and 2, an embodiment of the laundry machine according to the present invention will be explained.

A cabinet 10 defines an exterior appearance of the laundry machine and various elements which will be described later are installed within the cabinet 10. A drum 20 is rotatable in the cabinet 10. A motor 70 and a belt 68 drive the drum 20. A hot air heater 90 is provided in a predetermined portion of the cabinet 10 to heat air and to create high temperature air (hereinafter, hot air). A hot air supply duct 44 is provided in a predetermined portion of the cabinet 10 to supply the hot air of the hot air heater 90 to the drum 20. Also, there are provided an exhaustion duct 80, a blower unit 60 in the laundry machine according to the present invention. The damp air heat-exchanged with the laundry in the drum 20 is discharged outside the drum 20 through the exhaustion duct 80 and the blower unit 60 sucks the damp air. A steam generator 200 is provided in a predetermined portion of the cabinet 10 to generate high temperature steam.

This embodiment presents on convenience sake an indirect drive type in that the drum 20 is rotated by the motor 700 and the belt 68 and the present invention is not limited thereto. That is, it is possible to apply to the present invention a direct drive type in that the drum 20 is directly rotated by connecting the motor 70 to a rear surface of the drum 20.

Each configuration will be explained in detail.

The cabinet 10 defines an exterior appearance of the laundry machine and it includes a base 12, a pair of side covers 14, a front cover 16, a rear cover 18 and a top cover 17. The base 12 forms a bottom surface of the laundry machine and the side covers 14 are perpendicular to the base 12. The front cover 16 and the rear cover 18 are installed in a front portion and a rear portion of the side covers 14, respectively. The tope cover 17 is installed in an upper portion of the side covers 14. A control panel 19 having various operational switches is positioned at the top cover 17 or the front cover 16 and the door 164 is coupled to the front cover 16. An air inlet 182 and an air outlet 184 are provided at the rear cover 18. External air is drawn through the air inlet 182 and the air inside the drum 20 is discharged outside through the air outlet 184 that is a final path to an outside.

An inner space of the drum 20 is employed as a drying chamber for drying the laundry. It is preferable that a lifter 22 is installed in the drum 20 to lift and drop the laundry, such that the laundry is turned over to enhance drying efficiency.

On the other hand, a front supporter 30 is provided between the drum 20 and the cabinet 10, in other words, between the drum 20 and the front cover 16. A rear supporter 40 is provided between the drum 20 and the rear cover 18. The drum 20 is rotatable between the front supporter 30 and the rear supporter 40, and sealing members (not shown) for preventing water leakage are coupled between the front supporter 30 and the drum 20 and between the drum 20 and the rear supporter 40, respectively. The front supporter 30 and the rear supporter 40 of the drum 20 close a front and a rear surface, respectively, to support a front and rear end of the drum 20 as well as to form the drying chamber.

An opening is formed at the front supporter 30 to communicate the drum 20 with an outside and the opening is selectively opened and closed by the door 164. In addition, a lint duct 50 as a path through which the air in the drum 20 flows outside is connected to the front supporter 30 and a lint filter 52 is installed at the lint duct 50.

In addition, a sensor 95 is provided at the front supporter 30. Specifically, as shown in FIG. 2, the sensor 95 is positioned in a lower portion of the front supporter 30 and projected toward the drum 20. that is, the sensor 95 is secured to the lower portion of the front supporter 30 that supports the drum and it sends a sensing signal that is generated by contacting with the laundry rotated by the rotation of the drum 20 to a controller (not shown) which will be described later. In this case, during the rotation of the drum 20, it is common that the laundry is gathered in front of the drum 20 and thus the sensor 95 may easily contact with the laundry inside the drum 20, because the sensor 95 is positioned at a front lower portion of the drum 20.

Although not shown in the drawings, the sensor may be installed in the drum 20 to rotate in communication with the drum 20. In this case, the sensor may be installed at the lifter 22 inside the drum 20. Even if the sensor is installed at the lifter 22, the laundry is repeatedly in contact and separation with the sensor of the lifter 22, which enables a sensing signal generated by the contact to be sensed. Next, the case that the sensor is secured to the front supporter 30 will be presented mainly.

Here, the sensor 95 may be an electrode sensor and the sensor 95 measures, if contacting with the laundry inside the drum 20, changes of voltage waves that are generated by the contact and transmits the changes to the controller (not shown). The controller analyzes the transmitted result and reads a laundry amount to control an operation of the dryer. Such the sensor 95 and the operation of the controller will be explained in detail.

A predetermined portion of the blower unit 60 is connected to the lint duct 50 and the other opposite predetermined portion of the blower unit 60 is connected to the exhaustion duct 80. Here, the exhaustion duct 80 is in communication with the air outlet 184 provided at the rear cover 18.

As a result, once the blower unit 60 is operated, the air inside the drum 20 flows through the lint duct 50, the exhaustion duct 80 and the air outlet 184 in order, only to be exhausted outside. At this time, foreign substances including lint are filtered by the lint filter 52. Commonly, the blower unit 60 is configured of a blower 62 and a blower housing 64. The blower 64 is commonly connected to the motor 70 for driving the drum 20.

An opening 42 formed of plural through-holes is formed at the rear supporter 40 and the hot air supply duct 44 is connected to the opening 42. The hot air supply duct 44 is in communication with the drum 20 and it is employed as a path for supplying hot air to the drum 20. For that, the hot air heater 90 is mounted in a predetermined portion of the hot air supply duct 44.

On the other hand, the steam generator 200 is provided in a predetermined portion of the cabinet 10 to generate steam and the generated steam is supplied to the drum 20.

Figure 3:
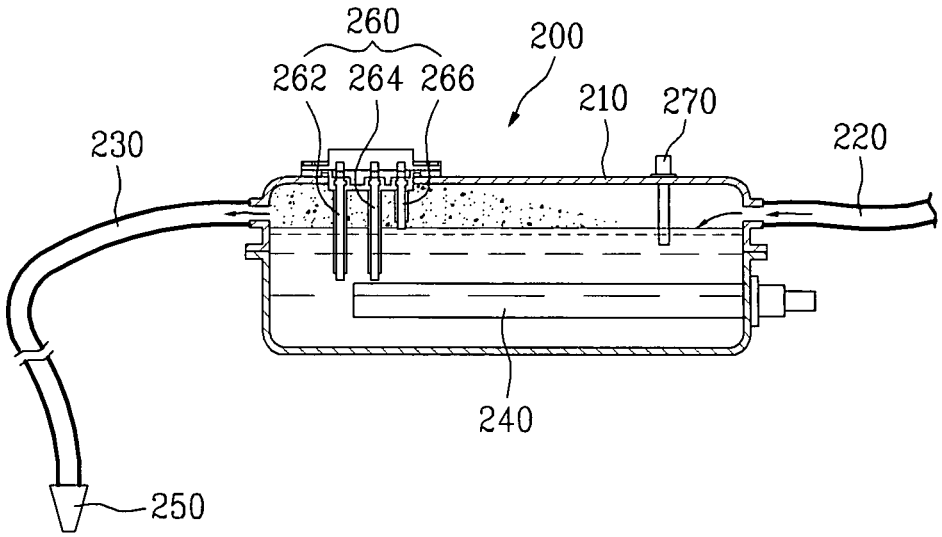
FIG. 3 is a sectional view illustrating a steam generator shown in FIG. 1.

FIG. 3 is a sectional view illustrating the steam generator of FIG. 1. In reference to FIG. 3, the steam generator 200 will be explained in detail. The steam generator 200 is configured of a tank 210, a heater 240, a water level sensor 260 and a temperature sensor 270. Water is held in the tank 210 and the heater 240 is mounted in the tank 210. The water level sensor 260 senses water levels in the steam generator 200 and the temperature sensor 270 senses temperatures in the steam generator 200. The water level sensor 260 is configured of a common electrode 262, a low water level electrode 264 and a high water level electrode 266. A high water level is sensed based on whether an electric current is applied between the common electrode 262 and the high water level electrode 266, and a low water level is sensed based on whether an electrode current is applied between the common electrode 262 and the low water level electrode 264.

A water supply hose 220 is connected to a predetermined portion of the steam generator 200 and a steam hose 230 is connected to the other opposite predetermined portion of the steam generator 200. Here, it is preferable that a nozzle 250 having a predetermined shape is provided at a front end of the steam hose 230. An end of the water supply hose 220 is typically connected to an external water supply source such as a water tap. The nozzle 250, that is, a steam outlet is positioned at a predetermined portion in the drum 20 to spray steam in the drum 20.

In the meantime, this embodiment presents a kind of the steam generator 200 in that the heater 240 heats the water in the tank 210 to generate steam (called as "tank heating type steam generator" on convenience sake) and the present invention is not limited thereto. That is, any devices capable of generating steam may be applicable to the present invention. For example, a kind of a steam generator in that a heater is directly installed around a water supply hose to heat the water in the water supply hose, without storing water in a predetermined space, (called as "a pipe heating type steam generator") may be applicable to the present invention.

Figure 4:
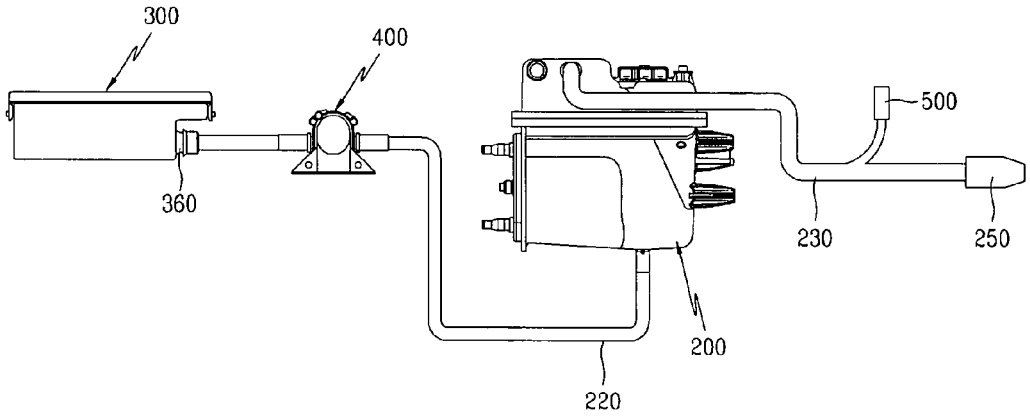
FIG. 4 is a diagram schematically illustrating a steam generator of a dryer according to another embodiment of the present invention.

FIG. 4 is a diagram schematically illustrating a steam generator of a dryer according to another embodiment of the present invention. In reference to FIG. 4, another embodiment of a laundry machine according to the present invention will be explained.

This embodiment presents that the water supply source may be detachable. The water supply source might be a water tap like in the above embodiment and its installation structure may be complex in this case, because additional installation of various devices is necessary. To solve the problem, water is supplied by using a detachable water supply source 300 in this embodiment and the detachable water supply source 300 filled with water is connected to a water supply path, that is, a water supply hose 220, which is quite convenient.

In addition, a pump 400 may be provided between the water supply source 300 and the steam generator 200. It is preferable that the pump 400 is rotatable in a clockwise and counter-clockwise direction and that the pump 400 allows water to be supplied to or drained from the steam generator 200.

It is possible to supply water to the steam generator 200 by using water level difference between the water supply source 300 and the steam generator 200. However, this case results in lack of structural space, because it is common that various parts of dryers are standardized goods compactly designed. As a result, the water supply using the water level difference is substantially impossible unless the sizes of conventional dryer parts are changed. While, if a small sized pump 400 is used, there may be enough space for the steam generator 200 without changing the sizes of the parts and this is very advantageous to use the pump 400 according to the present invention. If the steam generator 200 is not used for a relatively long time, the heater might be damaged by remaining water or polluted water might be used later. Thus, it is preferable that the remaining water in the steam generator 200 is drained.

While water is supplied or steam is discharged through the upper portion of the steam generator 200, it is preferable that water is supplied to the steam generator 200 through a lower portion of the steam generator 200 and that steam is discharged from the steam generator 200 through the upper portion of the steam generator 200 in this embodiment. In this case, it is convenient to drain the remaining water in the steam generator 200. In addition, it is preferable that a safety valve 500 is provided at a steam path through which steam is discharged from the steam generator 200 and the steam path is a steam hose 230.

Next, in reference to the drawings, each configuration will be explained in detail.

Figure 5:
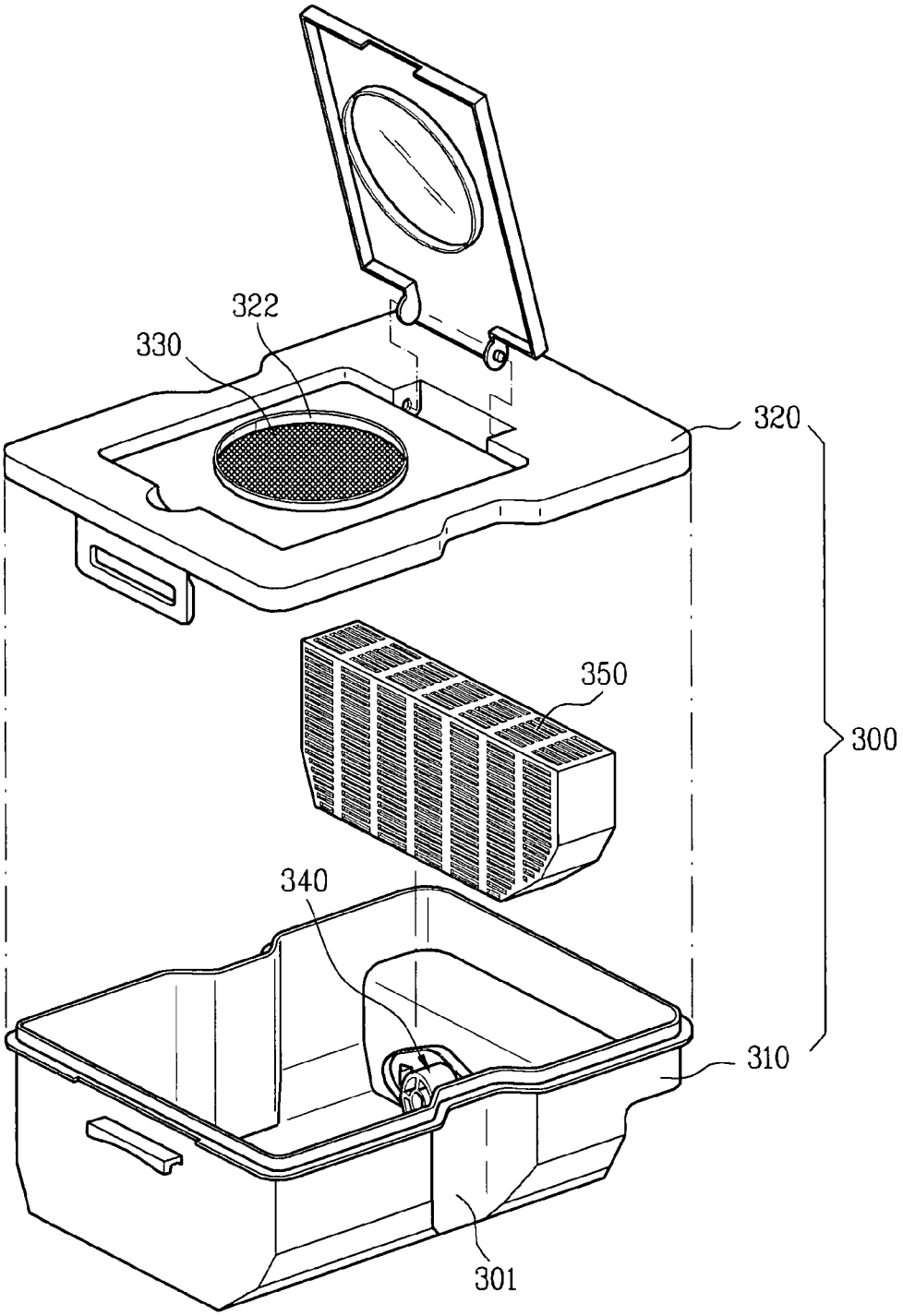
FIG. 5 is an exploded perspective view illustrating an embodiment of a water supply source shown in FIG. 4.

First of all, in reference to FIG. 5, the detachable water supply source 300 (hereinafter, a cartridge) will be explained.

The cartridge 300 includes a lower housing 310 that substantially holds water and an upper housing 320 detachable from the lower housing 310. As a result, it is easy to wash and clean slime inside the cartridge 300. Also, it is easy to separate, clean and regenerate filters 330 and 340 and a water softening member 350.

It is preferable that a first filter 330 is provided at the upper housing 320. That is, the first filter 330 is installed at a water inlet of the upper housing 320 and water is primarily filtered when supplied to the cartridge 300.

A closable member (360, see FIG. 4) is provided at the lower housing 310 to selectively supply the water of the cartridge 300 outside. If the cartridge 300 is separated, the water of the cartridge 300 is not discharged outside and if the cartridge 300 is installed, the water is discharged outside. A second filter 360 for filtering the water may be connected to the closable member 360 and it is preferable that the second filter 360 is detachable.

Using the first filter 330 and the second filter 340, impurities mixed with water such as minute dirt may be filtered doubly. The first filter 330 may be formed of an approximately 50 mesh net and the second filter 340 may be formed of an approximately 60 mesh net. Here, the 50 mesh net means that the mesh number per a predetermined section is 50. As a result, a size of each mesh hole forming the first filter 330 is larger than a size of each mesh hole forming the second filter 340, such that relatively large impurities are filtered by the first filter 330 primarily and relatively small foreign impurities are filtered by the second filter secondarily.

It is preferable that a water softening member 350 is provided in the cartridge 300 to soften water. It is also preferable that the water softening member 350 is detachable.

The reason why the water softening member 350 is used will be described. If the water supplied to the steam generator 200 has a high degree of hardness, Ca $(HCO_3)_2$ dissolved in the water is heated and $CaCO_3$ is educed. Thus corrosion of the heater might be caused by lime. Especially, this corrosion might be severe in Europe and America continents, because water in those areas is soft water having a high degree of hardness. Thus, it is preferable in those areas that calcium, magnesium and the like are removed by the ion exchange resin to prevent eduction of lime. The efficiency of the ion exchange resin deteriorates as a water softening process being performed and thus the ion exchange resin is regenerated in a predetermined time period to reuse the ion exchange resin. Here, a water softening process by using the ion exchange is 2(R—SONa)+Ca2<–>(R—SO)Ca+2N and an ion exchange resin regenerating process by using NaCl as Calcium decomposer is (R—So)Ca+SNaCl<–>2(R—SONa)+CaCl.

Figure 6:
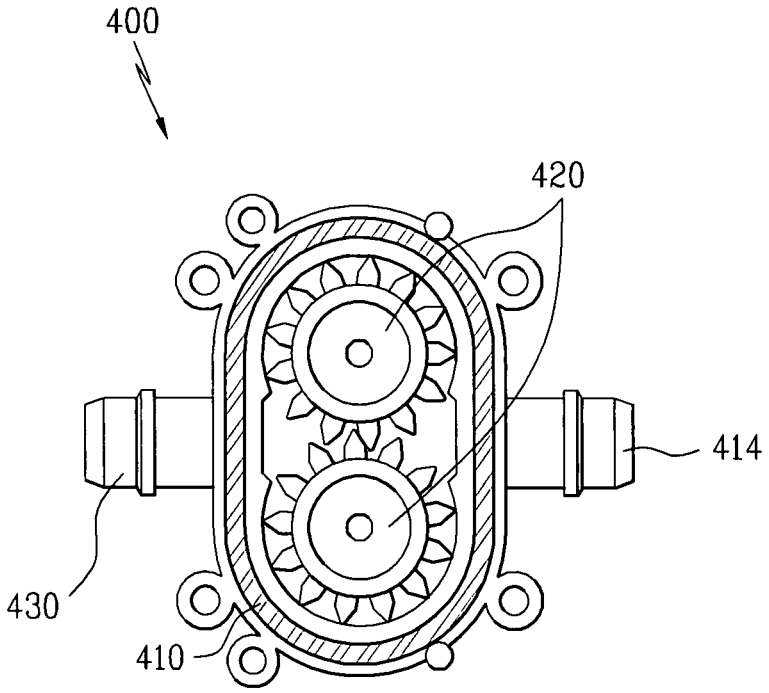
FIG. 6 is a sectional view schematically illustrating an embodiment of a pump shown in FIG. 4.

FIG. 6 is a sectional view schematically illustrating an embodiment of the pump according to the present invention.

In reference to FIG. 6, the pump 400 is employed to selectively supply water to the steam generator 200. In addition, the pump 400 may be rotatable in a clockwise and counter-clockwise direction and it may selectively supply water to the steam generator 200 or to drain water from the steam generator 200.

The pump 400 may be a gear type, pulsating type or diaphragm type pump. In the pulsating type and diaphragm type, a pole of a circuit is changed momentarily to control a flux of fluid in a clockwise and counter-clockwise direction.

FIG. 6 shows a gear type pump 400 as an example of the usable pumps. The gear type pump 400 includes a pair of gears 420 provided in a case 410. An inlet 430 and an outlet 414 are provided at the case 410. That is, based on a rotational direction of the gears 420, water may be flowing to the outlet 414 from the inlet 430 or to the inlet 430 from the outlet 414.

Figure 7:
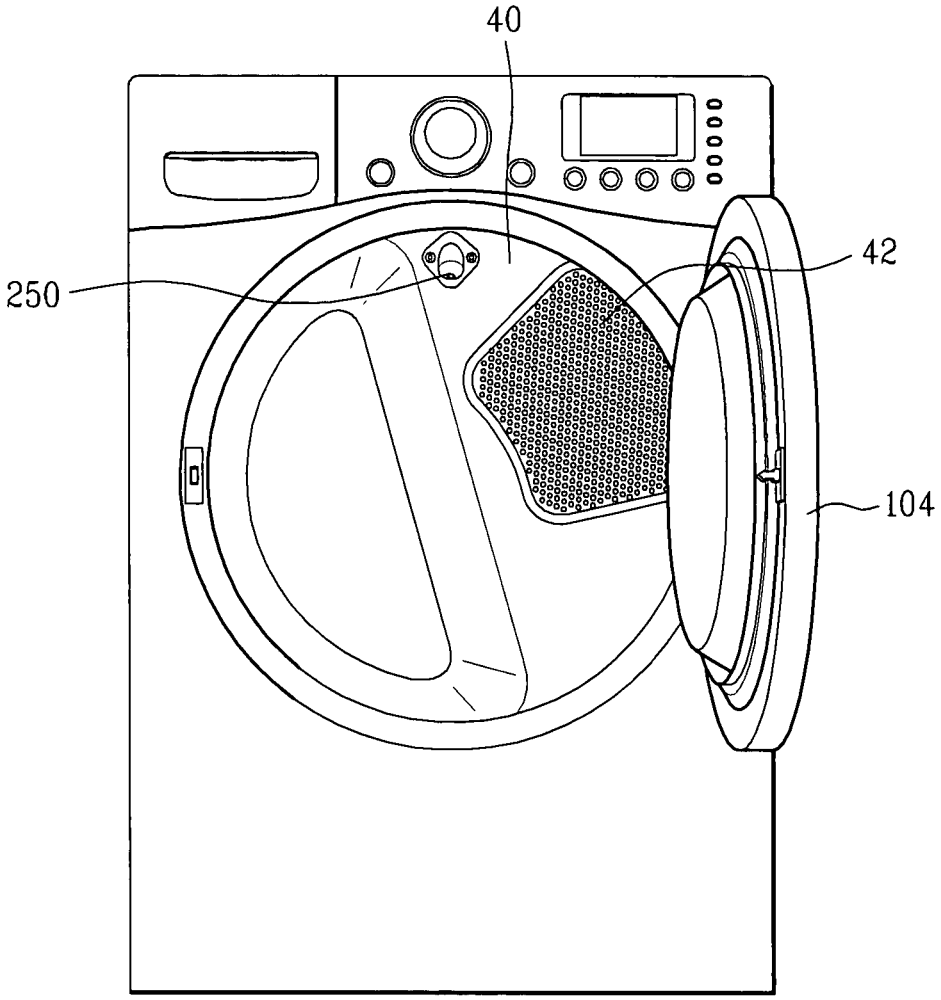
FIG. 7 is a front view illustrating a state of a nozzle of FIG. 4 being installed.

FIG. 7 is a front view illustrating a state of a nozzle being installed in the dryer according to the present invention.

In reference to FIG. 7, a nozzle 250 is installed adjacent to the opening 42 from which hot air is supplied to the drum and the nozzle 250 may spray steam toward a front surface from a rear surface of the drum. This is because air inside the drum is typically drawn from the opening 42 formed at the rear supporter 40 of the rear part of the drum and discharged through the lint duct (50, see FIG. 1) below the door 104 positioned at the front part of the drum. As a result, a path of air is approximately toward the lint duct 50 from the opening 42. When the nozzle 250 is adjacent to the opening 42 of the rear part to spray steam toward a lower portion of the door 104, the steam may flow smoothly along the air path only to reach the laundry inside the drum uniformly.

Figure 8:
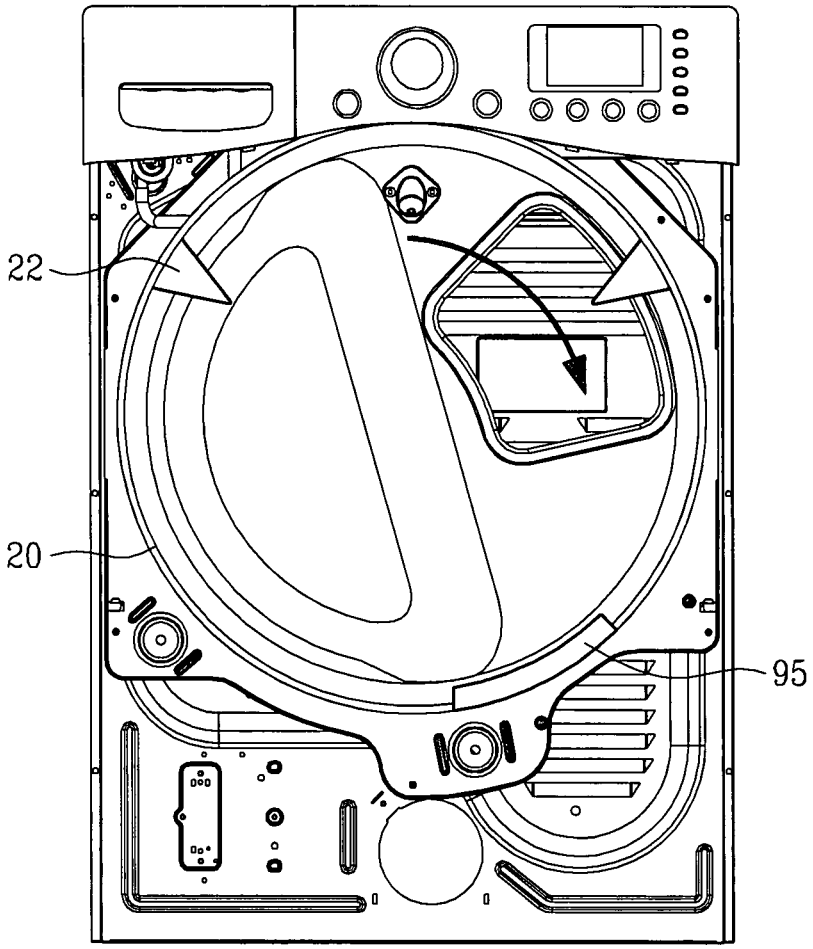
FIG. 8 is a front view illustrating a sensor without a front cover in FIG. 7.

FIG. 8 is a front view illustrating a state of the front cover 16 of FIG. 7 being separated and a state of the sensor 95 being installed to sense a laundry amount inside the drum 20.

Typically, dryers are operated based on preset control programs and it is difficult for a user to change the control programs. If a laundry amount is changed, a user has to measure a laundry amount for himself/herself and to input the laundry amount manually. This ends up with user's inconvenience of measuring the laundry amount manually. Moreover, it is quite difficult for a user to measure the laundry amount exactly and this may cause a problem that the laundry is not dried appropriately. To relive a user of such inconveniences, this embodiment presents that the sensor is provided in the dryer to automatically measure an amount of laundry, that is, a laundry amount and that an operation of a dryer may be controlled. As a result, it is possible in this embodiment to dry the laundry appropriately even if the laundry amount is changeable. Next, the sensor and a controlling method of the above dryer will be explained.

In reference to FIGS. 8 and 2, the sensor 95 is installed in a front portion of the drum 20 to sense a laundry amount. The sensor 95 senses the laundry amount, contacting with the laundry inside the drum 20. Specifically, the sensor 95 is projected toward the drum from the front supporter 30, near the front part of the drum 20. Of course, the sensor 95 may be secured to other portions of the drum 20, for example, in a rear portion of the drum 20, not in the front portion of the drum 20. However, it is common that the laundry inside the drum 20 is gathered in the front portion of the drum 20 when the drum 20 rotates. Thus, it is preferable that the sensor 95 is secured adjacent to the front portion of the drum 20.

Here, the sensor 95 may be an electrode sensor to measure voltage waves that are changed based on the contact with the laundry inside the drum 20. Specifically, as shown in FIG. 8, when the drum 20 rotates in a clockwise direction, the laundry inside the drum 20 is lifted by the lifter to a predetermined height and the laundry is not supported by the lifters over the predetermined height, and then the laundry is dropped into the lower portion of the drum 20 along an arrow of the drawing. The dropped laundry in the lower portion of the drum contacts with the sensor 95 and frequencies of the contact between the sensor 95 and the laundry may be changed based on the laundry amount. Since the frequencies of the contact between the sensor 95 configured of an electrode sensor and the laundry are variable, voltage waves measured by the sensor 95 may be variable based on the laundry amount.

Figure 9:
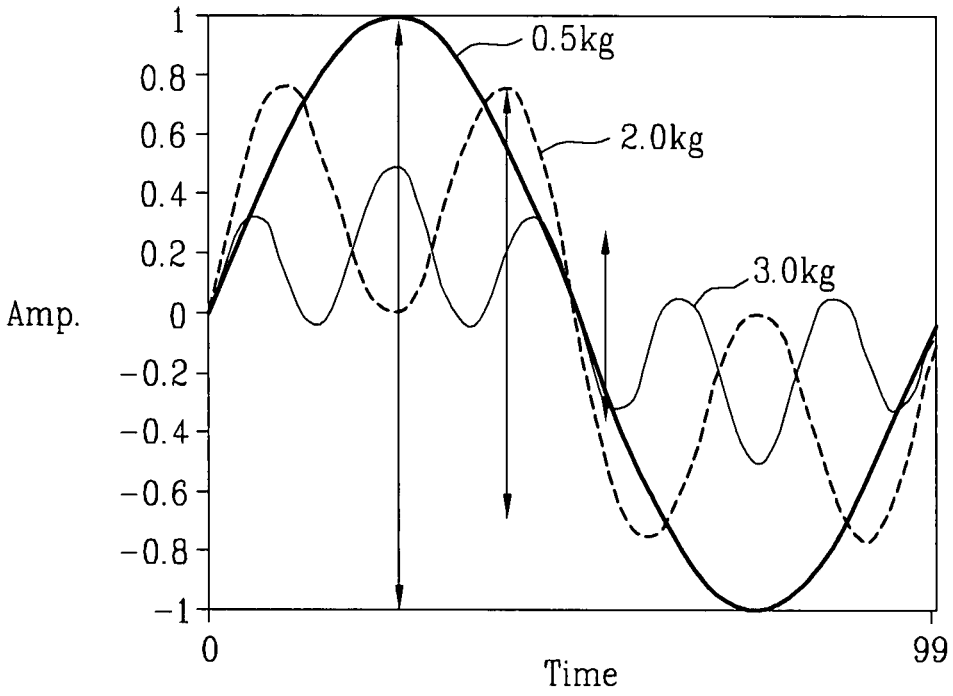
FIG. 9 is a graph illustrating an example of voltage waves measured by the sensor of FIG. 8 based on a laundry amount.

FIG. 9 is a graph illustrating an example of the changes of voltage waves measured by the electrode sensor 95 based on the laundry amount. In reference to FIG. 9, voltage waves measured by the sensor 95 in case of the laundry amount of 0.5 kg, 2.0 kg and 3 kg, respectively, will be explained. In case that the least laundry amount is 0.5 kg, changes of voltage waves, in other words, amplitude is largest. Shown in FIG. 9, as the laundry amount is larger, the amplitude of the voltage is smaller. As a result, in this embodiment, the voltage waves measured by the electrode sensor 95 are transmitted to the controller (not shown) and the controller (not shown) analyzes the changes of amplitude from the transmitted voltages waves to interpret the laundry amount inside the drum 20.

Figure 10:
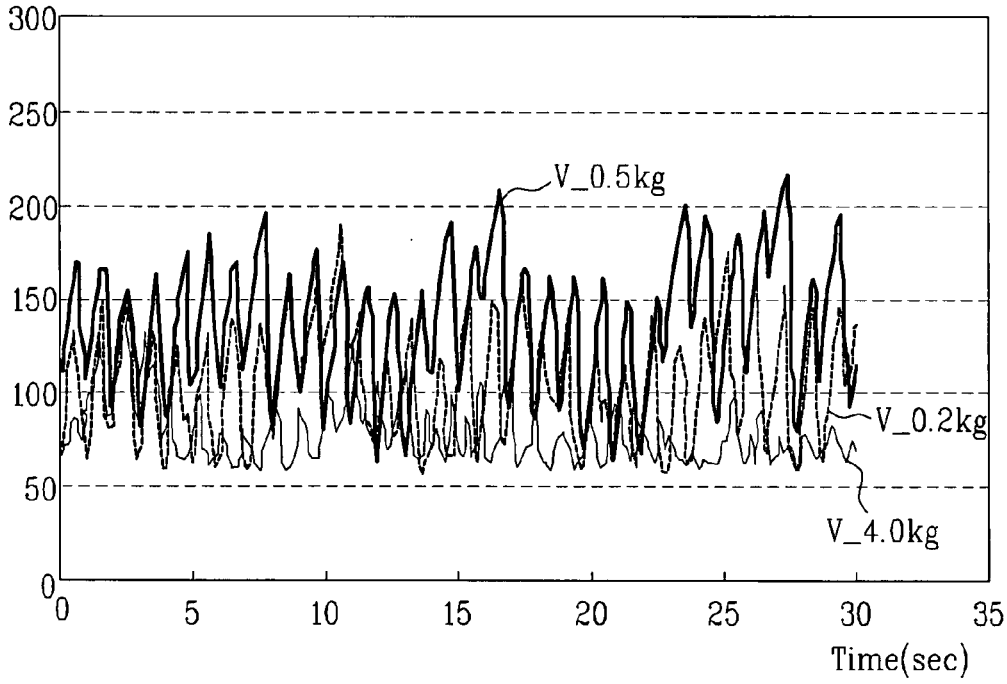
FIG. 10 is a graph illustrating an actual voltage waves measured by the sensor of FIG. 8 based on the laundry amount.

FIG. 10 is a graph showing voltage waves that are actually measured by the sensor 95 in case that the laundry amounts are 0.5 kg, 2.0 kg and 4.0 kg. Shown in FIG. 10, as the laundry amount is changed, the amplitude of voltage waves measured by the sensor 95 is changed accordingly. Next, a method of interpreting the laundry amount by using the voltage waves will be explained in reference to FIGS. 11 to 15.

Figure 11:
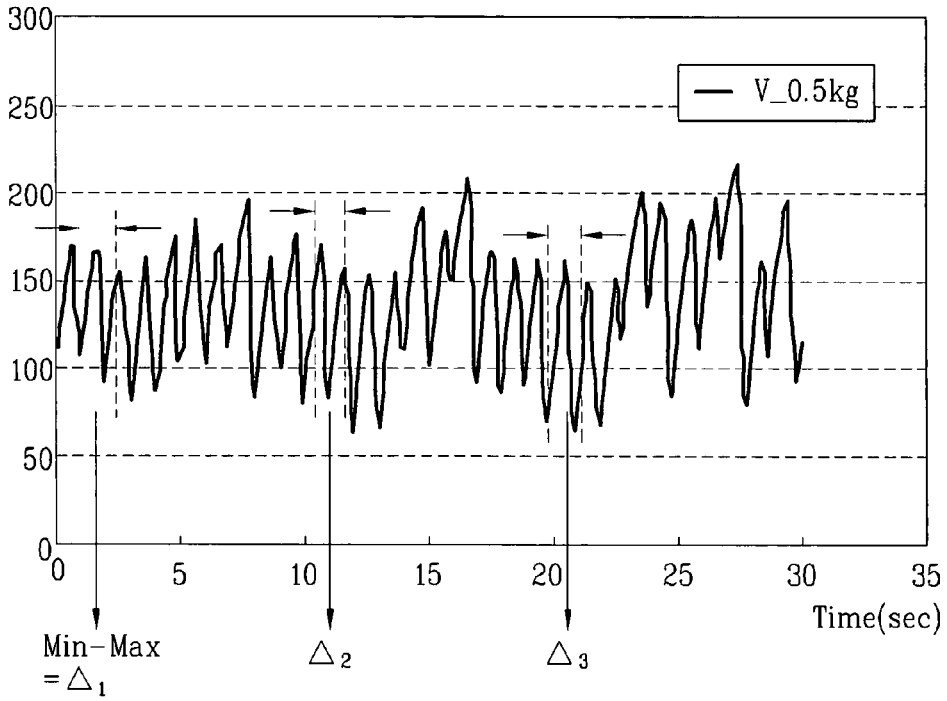
FIG. 11 is a graph illustrating a Max-Min average method out of methods in that the voltage waves measured by the sensor are analyzed.
Figure 12:
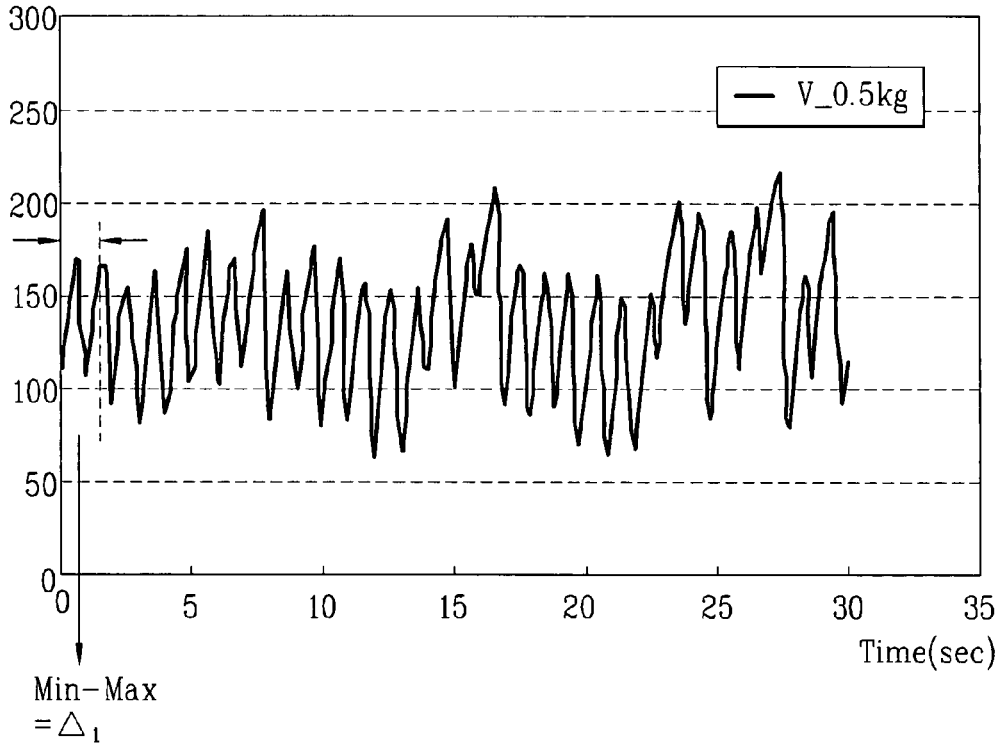
FIGS. 12-13 are graphs illustrating a Max-Min section method out of the methods in that the voltage waves measured by the sensor are analyzed, respectively.
Figure 13:
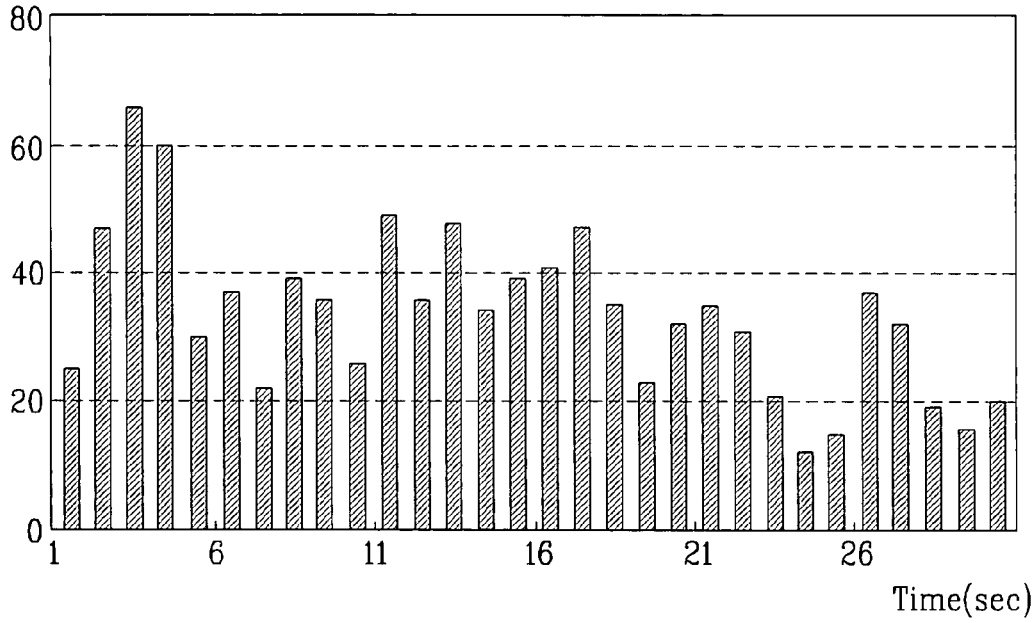
Figure 14:
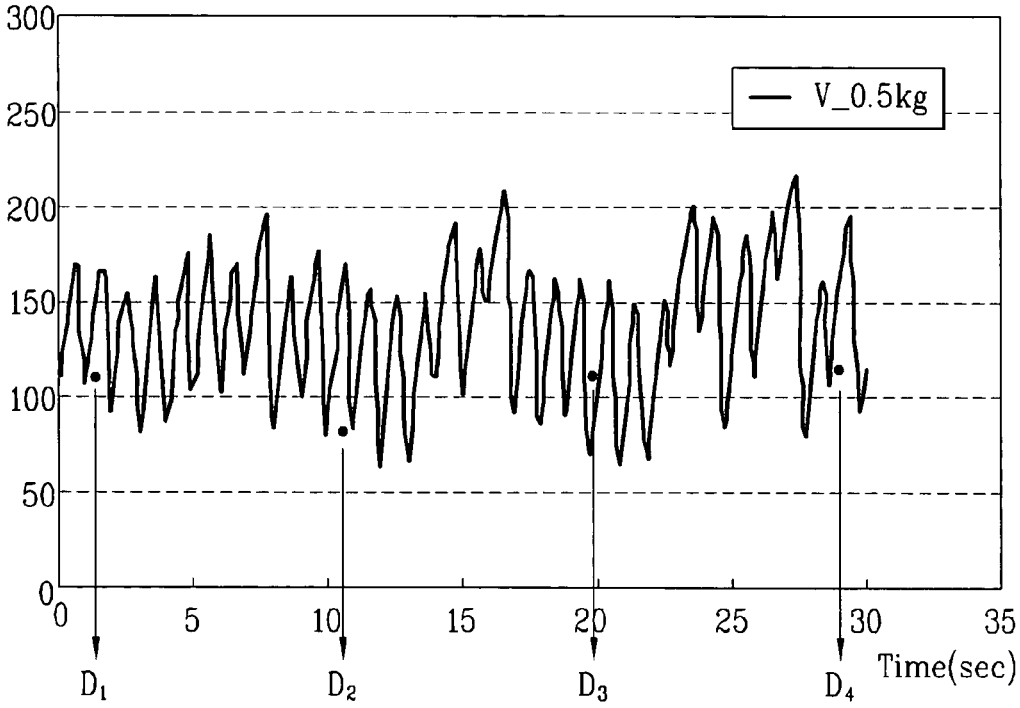
FIGS. 14 and 15 are graphs illustrating a random sampling method out of the methods.
Figure 15:
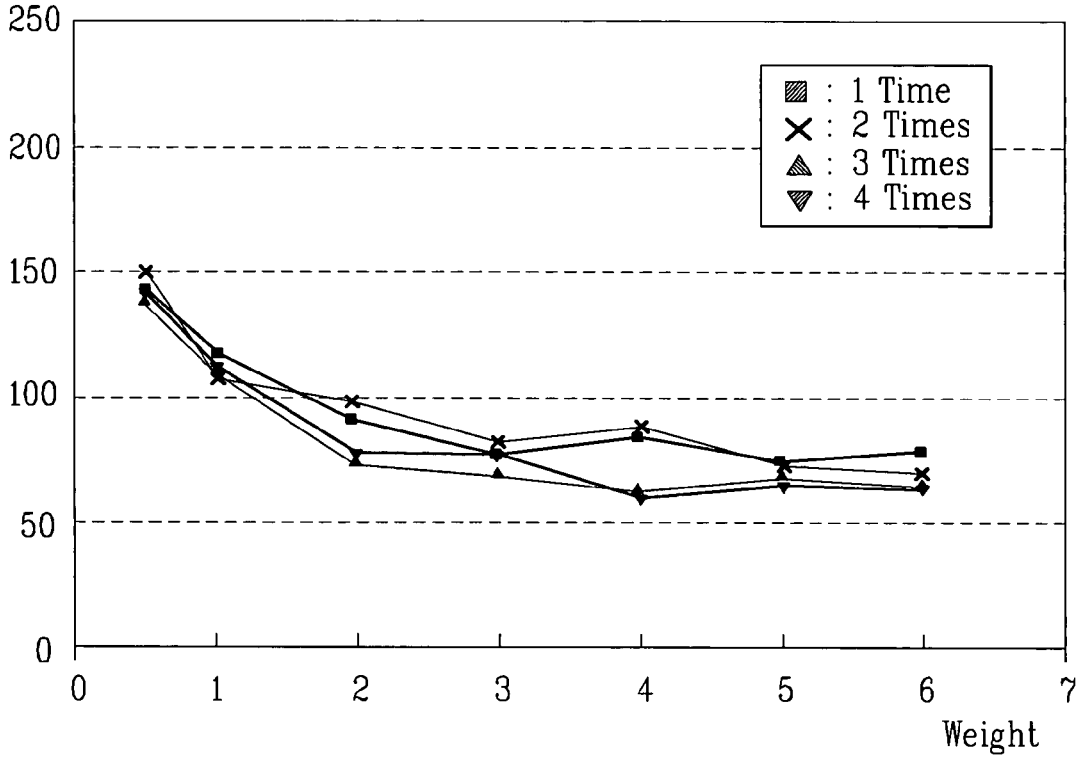

FIGS. 11 to 15 are diagrams to explain how the controller analyzes changes of voltage wave, respectively. FIG. 11 shows an analysis based on a Min-Max average method. FIGS. 12 and 13 shows analyses based on a Min-Max section method, respectively. FIGS. 14 and 15 show an analysis based on a random sampling method.

First of all, FIG. 11 shows voltage waves measured by the sensor 95 in case that a predetermined laundry amount, for example, 0.5 kg is loaded in the drum 20. According to the Min-Max average method, a minimum value and a maximum value are calculated from voltage waves at a predetermined interval for a predetermined time period and an average value between the minimum and the maximum is calculated. Hence, the average value is compared with a preset standard average value inputted based on a laundry amount to determine a laundry amount inside the drum 20.

Specifically, in this Min-Max average method, a minimum value of voltages and a maximum value of voltages are calculated at an interval of 10 seconds for 2 minutes. Here, the maximum value and the minimum value are calculated by measuring changes of voltage waves for 1 second.

That is, a sampling time for 1 second every 10 seconds is 0.1 second and a size of 10 times voltage is evaluated. The largest one of the measured values is the maximum value and the smallest one is the minimum value, and thus the difference between the two is a difference value (Δ) The calculated difference value is measured every second for 2 minutes and total 12 difference values (Δ1, Δ2, Δ3, . . . and Δ12) are calculated. Hence, an average value (Avg(Δ1~12)) is calculated and the average value is compared with a preset standard value to determine the laundry amount. Mentioned above, as the laundry amount is smaller, the amplitude, in other words, the difference between the minimum value and the maximum value is larger. Accordingly, as the average value is larger, the laundry amount is smaller. At this time, it is preferable that the standard values compared with the measured average value are inputted in the controller based on experiments in advance.

FIG. 12 shows voltage waves measured by the sensor 95 in case that a predetermined laundry amount, for example, 0.5 kg is loaded in the drum 20. In reference to FIG. 12, the laundry amount analysis based on the Min-Max section method will be explained.

According to the Min-Max section method, the difference value between a minimum value and a maximum value in the graph of FIG. 12 is changed into a section as shown in FIG. 13. Specifically, voltage changes are measured for 1 second. Here, a horizontal shaft is a time and a vertical shaft is a voltage value to illustrate the difference between the minimum value and the maximum value as section.

Here, the maximum value and the minimum value are calculated by calculating sizes of 10 times voltages based on a sampling time of 0.1 second for 1 second. The largest one of the measured values is a maximum value and the smallest one is a minimum value. the difference between the maximum and the minimum value is a difference value (Δ). A difference value measured every 1 second for 2 minutes and 12 difference values are calculated. Hence, the difference values are expressed as section and all of the sections are added up. The added sections are compared with preset standard values based on laundry amounts to determine a laundry amount inside the drum. As the laundry amount is smaller, the amplitude, in other words, the difference between the minimum vale and the maximum value is larger. Accordingly, as the added value is larger, the laundry amount is smaller. As the added value is smaller, the laundry amount is larger. At this time, it is preferable that the above standard values compared with the measured added value are inputted in the controller based on experiments in advance.

FIG. 14 is a graph to explain an analysis based on the random sampling method. FIG. 14 shows voltage waves that are measured by the sensor 95 in case that the drum 20 having a predetermined laundry amount, for example, 0.5 kg is rotated.

According to the random sampling method, voltage values are measured continuously at a predetermined interval and an average of the measured voltage values is calculated. The average value is compared with a preset standard value to determine a laundry amount.

Specifically, in this random sampling method, voltage values are measured from the measured voltage waves at an interval of 10 seconds for 2 minutes and 12 voltage values (D1, D2, . . . and D12) are calculated. Hence, an average value of the measured voltage values is calculated and the average value (Avg(D1~D12)) is compared with a preset standard value to determine a laundry amount inside the drum 20.

FIG. 15 shows the average voltage calculated by the random sampling method, with changing the laundry amounts. In FIG. 15, horizontal shafts show laundry amounts and vertical shafts show average voltage values. Specifically, in FIG. 15, four average voltage values with respect to laundry amounts of 0.5 kg, 1 kg, 2 kg, 3 kg, 5 kg and 6 kg are measured. In reference to FIG. 15, when the laundry amount is 0.5 kg, the average value is approximately 140, which is the largest. As the laundry amount is larger, the average voltage value is smaller.

According to FIG. 15, if four experiments are performed for each laundry amount, an average voltage value calculated for each laundry amount is almost regular. As a result, the average voltage value calculated by the repeated experiments for each of the laundry amount is preset in the controller as a standard value and an average voltage value is calculated from the voltage waves measured by the sensor 95. Hence, the average voltage value is compared with the preset standard value and an actual laundry amount inside the drum 20 is determined.

Once the laundry amount is determined by the controller, using the voltage waves measured by the sensor 95, the controller controls an operation of the dryer to dry the laundry without wrinkles and such the controlling method of the controller will be described later.

Figure 16:
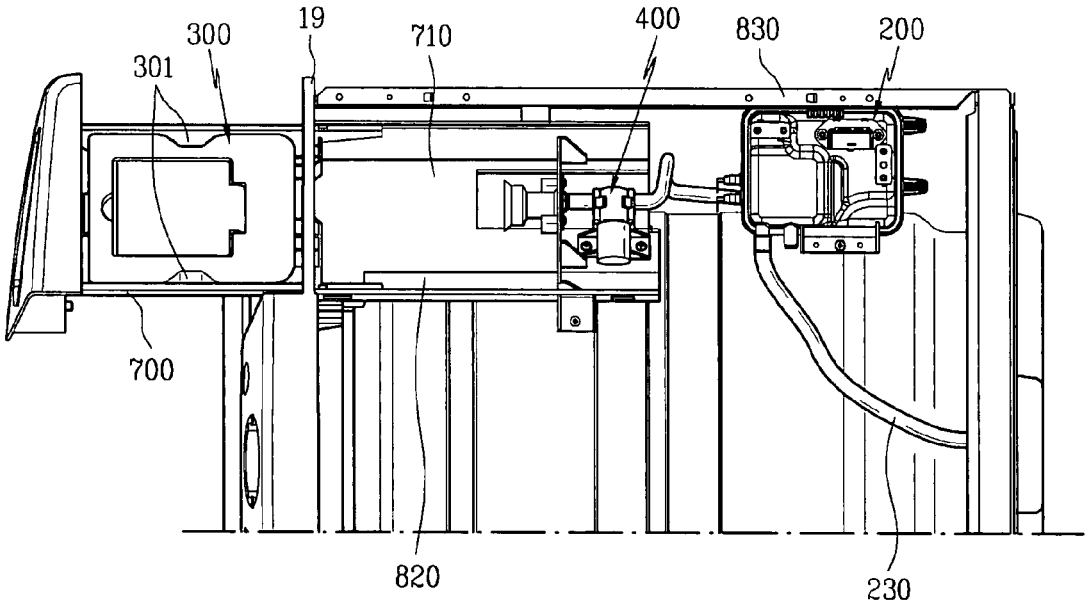
FIG. 16 is a perspective view illustrating installation examples of each element of FIG. 14.

FIG. 16 is a perspective view illustrating an installation example of each configuration mentioned above.

In reference to FIG. 16, an embodiment of installation of each element provided in a steam line configured of the steam generator according to the present invention will be explained.

A drawer type container 700 (hereinafter, a drawer) that is separable is provided in a predetermined portion of the cabinet 10 (see FIG. 1). It is preferable that a cartridge 300 is detachable from the drawer 700. In this case, the cartridge 300 is detachably mounted in the drawer 700 and the drawer 700 is moving inserted or separated so that the cartridge 300 is indirectly connected with or separated from the pump 400, not directly connected with the pump 400.

It is preferable that the drawer 700 is provided in a front surface of the dryer, for example, a control panel 19. A supporter 820 is installed in rear of the control panel 19. Specifically, the supporter 820 is installed in substantially parallel with a top frame 830 and a drawer guide 710 is installed at the supporter 820 and the top frame 830 to guide and to support the drawer 700.

An upper portion and another predetermined portion (in a direction to a front surface of the dryer) of the drawer guide 710 are opened for the drawer 700 to be inserted and detached through a front opened portion of the dryer. The pump 400 may be provided at an upper surface of the drawer guide 710 that is opposite to the opening portion toward the front surface of the dryer.

As mentioned above, it is preferable that the drawer 700 is installed in the front surface of the dryer at user convenience sake. As FIG. 16 shows the dryer in that the control panel 19 is installed at the front cover, the drawer 700 is separable from the control panel 19. However, the present invention is not limited thereto and the drawer 700 may be directly installed at the front cover if the control panel is installed at the top cover, for example, as shown in FIG. 1.

On the other hand, if the cartridge 300 is mounted in the drawer 700, shapes of at least both opposite sides of the cartridge 300 are corresponding to shapes of both opposite sides of the drawer 700 to be coupled suitably. In addition, a recess 301 is formed at both opposite sides of the cartridge 300 for smooth detachment and the cartridge 700 is mountable and detachable smoothly because of the recess 301.

In reference to FIG. 16, a method of supplying water to the cartridge 300 will be explained.

Once a user separates the drawer 700, the cartridge 300 is separated together with the drawer 700 and the cartridge 300 is detached from the drawer 700 in such a state. Water is supplied to a water supplying part 322 of the detached cartridge 300 to fill up the cartridge 300 and the cartridge 300 filled with water is mounted in the drawer 700 again and the drawer 700 is insertedly installed. Hence, a closable member 360 of the cartridge 300 is automatically connected with the pump 400 so that the water inside the cartridge 300 is discharged toward the pump 400.

After the operation of the dryer is completed, the cartridge 300 is detached from the drawer 700 in contrast as mentioned above. It is easy to clean the detached cartridge 300 because the cartridge 300 according to the present invention is configured of the upper housing 320 and the lower housing 310.

Next, a controlling method to dry the laundry by using the dyer having the above structure.

Figure 17:
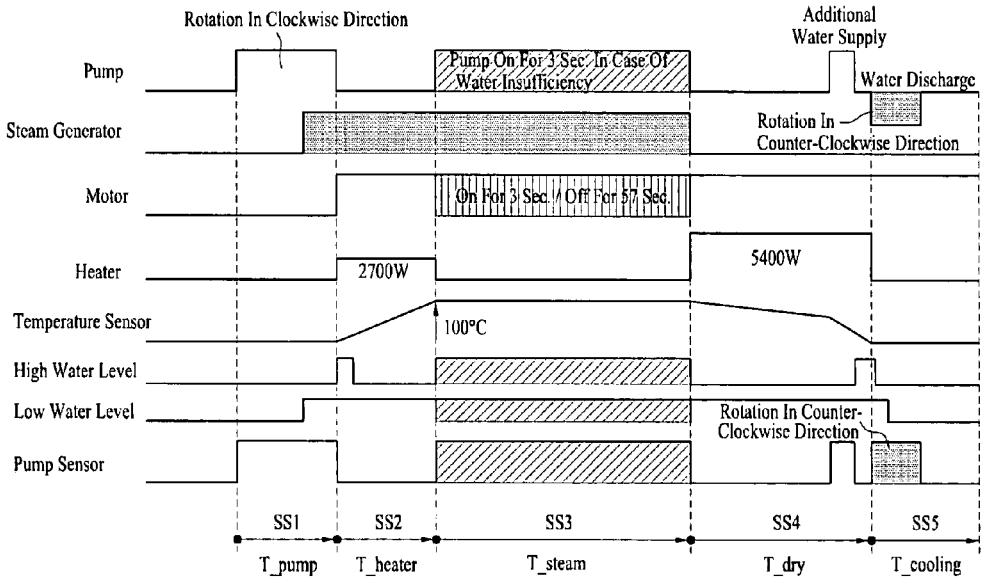
FIG. 17 is a diagram illustrating an embodiment of a controlling method of the dryers according to the above embodiments.

FIG. 17 is a diagram illustrating an embodiment of the controlling method of the dryer according to the above embodiments of the present invention.

In reference to FIG. 17, the controlling method of the dryer according to the present invention includes a drum heating step SS2 to supply steam generated by the steam generator to the drum, a steam supplying step SS3 to supply the steam to the drum and a hot air supplying step SS4 to supply hot air to the drum. Here, it is preferable that a water supplying step SS1 is performed prior to the drum heating step SS2 and that the controlling method further includes a cooling step SS5 to cool the laundry, after the hot air supplying step SS4. In addition, it is preferable that the controlling method further includes a water discharging step to discharge remaining water of the steam generator outside after completing the steam supplying steam SS3 and that the controlling method further includes a static electricity removing step to remove static electricity by spraying a small amount of steam after the cooling step SS5. Although an auxiliary heater may be mounted in the drum to heat the drum, it is simple to use the hot air heater.

Next, each above step will be explained in detail.

The drum is heated at a predetermined temperature in the drum heating step SS2 and this step SS2 is for an effect of removing wrinkles of the steam supply step SS3 to be performed smoothly. The drum heating step SS2 is performed for a predetermined time period (T_heater). At this time, the drum may be tumbled by an operation of the motor and it is preferable that the drum may be tumbled intermittently. The tumbling means that the drum is rotated below a speed of 50 rpm and it is well-known knowledge in the art to which the present invention pertains, such that the detailed description thereof will be omitted.

In the meantime, a laundry amount sensing step to sense a laundry amount by using the sensor 95 is performed during the drum heating step SS2. That is, when the drum is rotated by the operation of the motor in the drum heating step SS2, the sensor senses voltage waves and the controller analyzes the voltage waves to determine the laundry amount. When the sensor measures the voltage waves, the drum heating time (T_heater) may be at least longer than the time taken for the sensor to measure the voltage waves. In this embodiment, the voltage wave measurement time is at least 2 minutes. It is preferable that the drum heating time (T_heater), the time taken for the drum to be heated is at least 2 minutes. Here, the above times are examples and may be variable accordingly, not limited thereto.

It is preferable that the drum heating step SS2 starts at the moment when water is supplied to the steam generator by the operation of the pump to a predetermined high water level for a predetermined time period (T_pump). That is, the water supplying step SS1 is performed prior to the drum heating step SS2.

Here, although not shown in the drawings, there may be further a step of receiving a start command after a user selects a course using steam and a step of pumping water to the steam generator after the pump is operated in a primary stage of the selected course. There might be overload in the pump or water might be leaked to overflow, if water is continuously supplied in case of a water supply malfunction, for example, there is no water in the cartridge in the primarily stage of the selected course or the cartridge is wrongly connected with the pump or there is a malfunction of the pump. As a result, it is preferable that a user is informed of a water supply malfunction to take an appropriate action.

Thus, there may be after the pumping step further steps of determining whether there is a water supply malfunction and of informing a user of a water supply malfunction if there is one. Here, it is determined by using at least one of a water level of the water level sensor and an output current voltage of the pump of the steam generator. specifically, it is determined that there is a water supply malfunction if a water level of the water level sensor is not higher in a predetermined time period after the operation of the pump or the output current or voltage of the pump is noticeably high or low, comparing to the case of generally pumping water.

When it is determined that there is a water supply malfunction, it is preferable that the selected course is stopped. Hence, if a user takes an appropriate action to solve the water supply malfunction, for example, water is supplied to the cartridge if water is insufficient or a user inputs a start command again, for example, a pump malfunction is solved, the stopped course is continuously performed. In this case, the user pushes the start button again to input the start command again.

On the other hand, although a water supply time (T-pump) is not limited, water is supplied for a predetermined time period not to overflow from the steam generator. In addition, an operation of the steam heater starts a predetermined time period earlier than the time of starting the drum heating step SS2. This is because steam is generated in a predetermined time after the operation of the steam heater starts. If the drum is heated during the steam supply, the supplied steam may not reach the laundry uniformly and thus it is preferable that the drum heating step SS2 is completed at the moment when the steam is generated.

In the steam supply step SS3, steam is supplied to the drum mainly to remove wrinkles. If insufficient steam is supplied, compared to the laundry amount inside the drum, wrinkles may not be removed sufficiently. If too much steam is supplied, compared to the laundry amount, the laundry may not be dried sufficiently in the following hot air supplying step SS4. as a result, the steam supply step SS3 of this embodiment is performed for a predetermined time period (T_steam) and the steam supplying time (T_steam) is especially, automatically variable based on the laundry amount by the control of the controller.

In other words, the controller determines the laundry amount inside the drum based on the voltage waves measured by the sensor as mentioned above and adjusts the steam supply time (T_steam) based on the determined laundry amount. Specifically, an appropriate steam supply times according to each laundry amount are preset in the controller. Using the sensor, the controller controls steam to be supplied for the preset time (T_steam) predetermined according to the determined laundry amount. In this case, as the laundry amount is smaller, the steam supplying time (T_steam) is shorter. As the laundry amount is larger, the s team supplying time (T_steam) is longer. As a result, an appropriate amount of steam may be supplied based on a laundry amount inside the drum in the dryer according to the present invention and thus wrinkles of laundry can be removed sufficiently.

In the steam supplying step SS3, the drum may be tumbled and it is preferable that the drum is tumbled intermittently. The drum and the blower unit are operated by using the single motor in this embodiment. Thus, if the drum is tumbled by using the motor, the blower unit is operated together and the steam supplied to the drum may be discharged outside the drum by the blower unit. The steam might not be supplied to the laundry. If the drum and the blower unit are operated by the single motor like this embodiment, it is preferable that the drum is tumbled intermittently in the steam supplying step SS3. At this time, the tumbling may be intermittently repeated, for example, for 3 minutes per 1 minute. Although not shown in the drawings, separate motors to operate the drum and the blower unit may be provided and if then the drum may be continuously tumbled.

In the steam supplying step SS3, a water level of the steam generator is lowered and it is preferable that water is supplied if a low water level is sensed. Here, if water is continuously supplied to a high water level, much cold water is supplied to the steam generator in an instant and steam might not be sprayed. Thus, it is preferable for heating efficiency that water is supplied for a predetermined time period before a water level reaches a high level, for example, for 3 minutes.

In the hot air supplying step SS4, hot air is supplied to the drum by the hot air heater to re-dry the laundry slightly wet by steam. The hot air supplying step SS4 is performed for a predetermined time period (T_dry) and the hot air supplying time (T_dry) is automatically adjusted based on the determined laundry amount by the controller, like the steam supplying step SS3. A method of controlling the hot air supplying time (T_dry) by the controller is similar to the method of controlling the steam supplying time (T_steam) as mentioned above and detailed explanation of the method will be omitted. Here, it is also preferable that the drum is tumbled in the hot air supplying step SS4 and that remaining water of the steam generator is discharged into the cartridge after the hot air supplying step SS4. Since the reaming water of the steam generator is high temperature water, the remaining water is not discharged right after the hot air supplying step and a predetermined time is delayed, and thus the remaining water is discharged, if the temperature of the steam generator is below a predetermined value.

In the cooling step SS5, the laundry of which temperature is high in the hot air supplying step SS4 is cooled again. The cooling step SS5 is performed for a predetermined time period (T_cooling) and it is preferable that the drum is tumbled in the cooling step SS5. The cooling time (T_cooling) of the cooling step SS5 may be adjustable based on the laundry amount. However, as the laundry amount has little influence on the cooling step SS5, cooling may be performed according to a preset value. Although cool air may be supplied to the drum in the cooling step SS5, it is simple that the laundry is put in the drum for a predetermined time. This is because the temperature of the laundry is not relatively high.

In this embodiment, the static electricity removing step may be performed after the cooling step SS5 to remove static electricity of the laundry. There may be static electricity on the laundry having the steam supplying step SS3, the hot air supplying step SS4 and the cooling step SS5, which results in user's unpleasant feeling when putting on the laundry. Thus, this embodiment may include the static electricity removing step as a final step before the user takes out the laundry.

In the static electricity removing step, a small amount of steam may be sprayed to the laundry having the cooling step SS5 completed. If a large amount of steam is sprayed to the laundry, the laundry might be dampened again and thus it is preferable that steam as much as a user may not feel damp is sprayed to the laundry. The amount of steam sprayed to the laundry to remove static electricity may be also adjustable by the controller. That is, the amount of steam sprayed based on the laundry amount in the static electricity removing step may be adjusted by the controller. Since the specific controlling method by the controller is similar to the controlling method in the steam supplying step SS3, the detailed description of the controlling method in the static electricity removing step SS5 will be omitted. In case that steam is sprayed, the drum may be tumbled to remove static electricity of the laundry efficiently and it is preferable that the drum is tumbled intermittently.

In the meantime, the water supplying time (T_pump), the steam supplying time (T_steam), the drying time (T_dry), the cooling time (T_cooling), the tumbling time and the pump operating time shown in FIG. 17 are examples and they may be variable according to the capacity of the dryer and the laundry amount.

According to results of experiments performed by the present inventor, there is an effect of removing as well as preventing wrinkles in the present invention even with some differences according to kinds of fabric and degrees of moisture absorption. In addition, the laundry may be spin-dried laundry in a washer and the present invention is not limited thereto. For example, a piece of clothes that worn for a day or so, that is, a dry one with less wrinkles may be applicable to the present invention to remove wrinkles thereon. In other words, the dryer according to the present invention may be usable as a kind of wrinkle removing apparatus.

In the above embodiments, the sensor is explained to be secured to the dryer and the sensor according to the present invention is not limited thereto. For example, the sensor may be rotatable in communication with the rotation of the drum and the sensor may be installed at an inner circumferential surface of the drum, specifically, the lifter of the drum to rotate together with the drum.

Therefore, there may be effects of the dryer and controlling method thereof according to the present invention as follows.

First, the present invention has an effect that wrinkles of dried laundry may be removed as well as prevented efficiently. In addition, the laundry may be sterilized and bad smell of the laundry may be removed according to the present invention.

Furthermore, the present invention has another effect that wrinkles of dried laundry may be removed efficiently even without additional ironing.

A still further, the present invention has a still further effect that drying may be performed efficiently, because the laundry amount is automatically determined and drying is performed based on the determined laundry amount.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry machine, comprising:

a cabinet;

a drum rotatable in the cabinet;

a hot air heater to supply hot air to the drum by heating air;

a steam generator to generate and supply steam to the drum, the steam generator being provided in a predetermined portion of the cabinet;

a drawer type container provided in the cabinet, the drawer being provided in a control panel forming a front surface of the laundry machine;

a water supply source detachably mounted within the drawer to be filled with water by a user for storing and supplying the water to the steam generator;

a water supply path between the steam generator and the water supply source, wherein the water supply source is attached to the water supply path when the drawer type container is attached to the cabinet and the water supply source is separated from the water supply path when the drawer type container is separated from the cabinet;

a pump provided at the water supply path to supply water for generating steam from the water supply source to the steam generator;

a sensor to sense a laundry amount inside the drum; and a controller to control an amount of steam supplied to the drum based on sensing results of the sensor.

2. The laundry machine of claim 1, wherein the sensor is positioned at the rotatable drum.

3. The laundry machine of claim 2, wherein the sensor is positioned at a lifter inside the drum.

4. The laundry machine of claim 1, wherein the sensor is secured adjacent to the drum.

5. The laundry machine of claim 4, wherein the sensor is adjacent to a front portion of the drum.

6. The laundry machine of claim 1, wherein the sensor is configured of an electrode sensor.

7. The laundry dyer of claim 6, wherein the electrode sensor senses and transmits voltage waves that are variable based on the laundry amount inside the drum during the rotation of the drum, and the controller determines the laundry amount inside the drum based on the sensing results transmitted by the electrode sensor.

8. The laundry machine of claim 7, wherein the controller analyzes the voltage waves transmitted by the electrode sensor by selecting one of a Min-Max average method, Min-Max section method and random sampling method, to determine the laundry amount.

9. The laundry machine of claim 1, wherein when a water level in the steam generator is lowered during supplying steam the controller controls the water supply for a predetermined time period before the water level reaches a high level.

10. The laundry machine of claim 1, wherein the drawer type container is linearly separated from the cabinet along a path parallel to a rotation axis of the drum.

11. The laundry machine of claim 10, wherein the water supply source is filled through a water supplying part from above the drawer type container.

* * * * *